US006061940A

United States Patent [19]

Rice

[11] Patent Number: 6,061,940

[45] **Date of Patent: *May 16, 2000**

[54] ROAD UTILITY MARKER

[76] Inventor: Lawrence William Rice, 103 Duke St., Greer, S.C. 29650

[ * ] Notice: This patent issued on a continued prosecution application filed under 37 CFR 1.53(d), and is subject to the twenty year patent term provisions of 35 U.S.C. 154(a)(2).

[21] Appl. No.: 08/664,981

[22] Filed: Jun. 14, 1996

[51] Int. Cl.[7] ..... G09F 7/12

[52] U.S. Cl. ..... 40/594; 40/615; 40/671; 206/575

[58] Field of Search ..... 40/124.5, 594, 40/612, 615, 616, 661.09, 663, 760, 630, 638, 671; 404/9; 206/575; 248/467, 205.3, 205.4; 52/103, 105

[56] References Cited

U.S. PATENT DOCUMENTS

| | | | |
|---|---|---|---|
| 1,531,754 | 3/1925 | Palmer | 40/124.5 |
| 1,581,809 | 4/1926 | O'Brien | 404/9 |
| 1,788,004 | 1/1931 | Williams | 40/671 |
| 1,789,446 | 1/1931 | O'Brien | 40/612 |
| 2,298,364 | 10/1942 | Gits et al. | 40/616 |
| 2,679,373 | 5/1954 | Henley | 248/205.4 X |
| 2,963,805 | 12/1960 | Sterry | 40/671 |
| 4,108,311 | 8/1978 | McClendon | 206/573 |
| 4,133,919 | 1/1979 | Parsons | 427/259 |
| 4,579,754 | 4/1986 | Maurer et al. | 40/671 X |
| 4,667,829 | 5/1987 | Edmund-White | 206/575 |
| 4,738,060 | 4/1988 | Marthaler et al. | 52/103 |
| 4,976,055 | 12/1990 | Kane | 248/467 X |
| 4,985,101 | 1/1991 | Brown, Jr. | 40/615 X |
| 5,101,755 | 4/1992 | Barrett | 116/209 |
| 5,263,262 | 11/1993 | Steere, Jr. | 52/103 X |
| 5,556,686 | 9/1996 | O'Shea | 40/612 X |

FOREIGN PATENT DOCUMENTS

| | | | |
|---|---|---|---|
| 3721150 | 1/1989 | Germany | 40/612 |

*Primary Examiner*—Brian K. Green
*Attorney, Agent, or Firm*—Ralph Bailey, P.A.

[57] ABSTRACT

A marker and method for use on roads for locating underground utilities utilizing a flexible tile (A) constructed of front and backing layers of fused plastic having openings (B) for receiving screws (C) extending into corresponding holes drilled in the road surface for holding the tile while an adhesive backing sets and for assuring affixation thereafter. Suitable symbols (D) are formed into the tile by grinding away the front layer. All the components may be provided in a package utilizing a box or other container.

2 Claims, 4 Drawing Sheets

ROAD UTILITY MARKER

BACKGROUND OF THE INVENTION

This invention relates to utility markers for use on roads, highways, and the like for locating and indicating the nature of the utility. A flexible tile utilizes mechanical fasteners and an adhesive for permanent securement of the marker on a roadway surface such as a curb or edge of the pavement.

Utility markers are customarily provided utilizing plastic posts, tags, flexible plastic patches, and the like such as manufactured by VIP PRODUCTS of Houston, Tex. Other varieties of utility markers are manufactured by Carsonite International of Carson City, Nev. Such devices are commonly employed in marking underground utilities even though they lack permanency and are easily or inadvertently removable.

A further effort to solve the problem of providing relatively permanent utility markers is illustrated in U.S. Pat. No. 5,101,755. A right angled marker is disclosed wherein a recess in a face contains a fluorescent color additive or light reflective material having a narrow angle of reflectance. In addition to the reflective material, an indicator may be marked showing the location and distance to the utility. The indicia may include letters and numbers and other symbols. Such indicators are relatively expensive and are easily broken. Permanent means for affixing the markers to a road or street has not been contemplated.

The net result of these efforts is that home owners are often unhappy with the unsightly paint markings on their streets and flags on their front lawns. Utility companies are spending much money each year on either supplies and manpower to do in house locating or the hiring of a locating service.

SUMMARY OF THE INVENTION

Accordingly, it is an important object of the invention to provide a utility marker and method for use on road and highway surfaces and the like for locating underground utilities which may be permanently affixed on road surfaces.

Another object of the invention is to provide a utility marker incorporating a tile which is constructed of a front layer and a backing layer of fused plastic material which may be of contrasting colors so that symbols, color coding and other indicia including letters, numbers, engineering markings, and symbols may be incorporated in a front face by grinding away portions of the front layer leaving the underlying portions of the backing layer exposed.

Another important object of the invention is the provision of effecting means for affixing the tiles to roadway surfaces including curbs and the like wherein opposed holes are provided in the tiles for accommodating elongated fasteners such as screws, elongated fasteners and washers for placement in the road surface.

Another object of the invention is the provision of a utility marker incorporating a tile which may be supplied in suitable numbers together with screws and adhesive in suitable packages for distribution to the utilities and other users.

Another object of the invention is the provision of a method for securement of the tiles in position to locate an underground utility adjacent the roadway for indicating the nature of and the distance to the utility wherein an adhesive is applied to the back of the tile and screws are affixed through holes which have been drilled in the roadway surface for permanent affixation of the marker to the roadway surface.

In lieu of permanently indenting or engraving the surface of the tiles with the addition of UV resistant coloring material in the plastic, suitable indicia may be screen printed on the face of the tiles utilizing UV resistant dyes, pigments and other coloring material. It may be desirable to coat the back of a tile made from clear plastic by screen printing with a suitable coating if desired applied thereover. Adhesive may be applied to the backing surface thus provided.

Markers constructed in accordance with the invention are capable of withstanding the elements of the four seasons as well as the demands of high traffic areas. Repeat markings are avoided and a quick and easy means is provided for locating valves and services at mains, test stations, ends of mains, and all other types of utilities.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
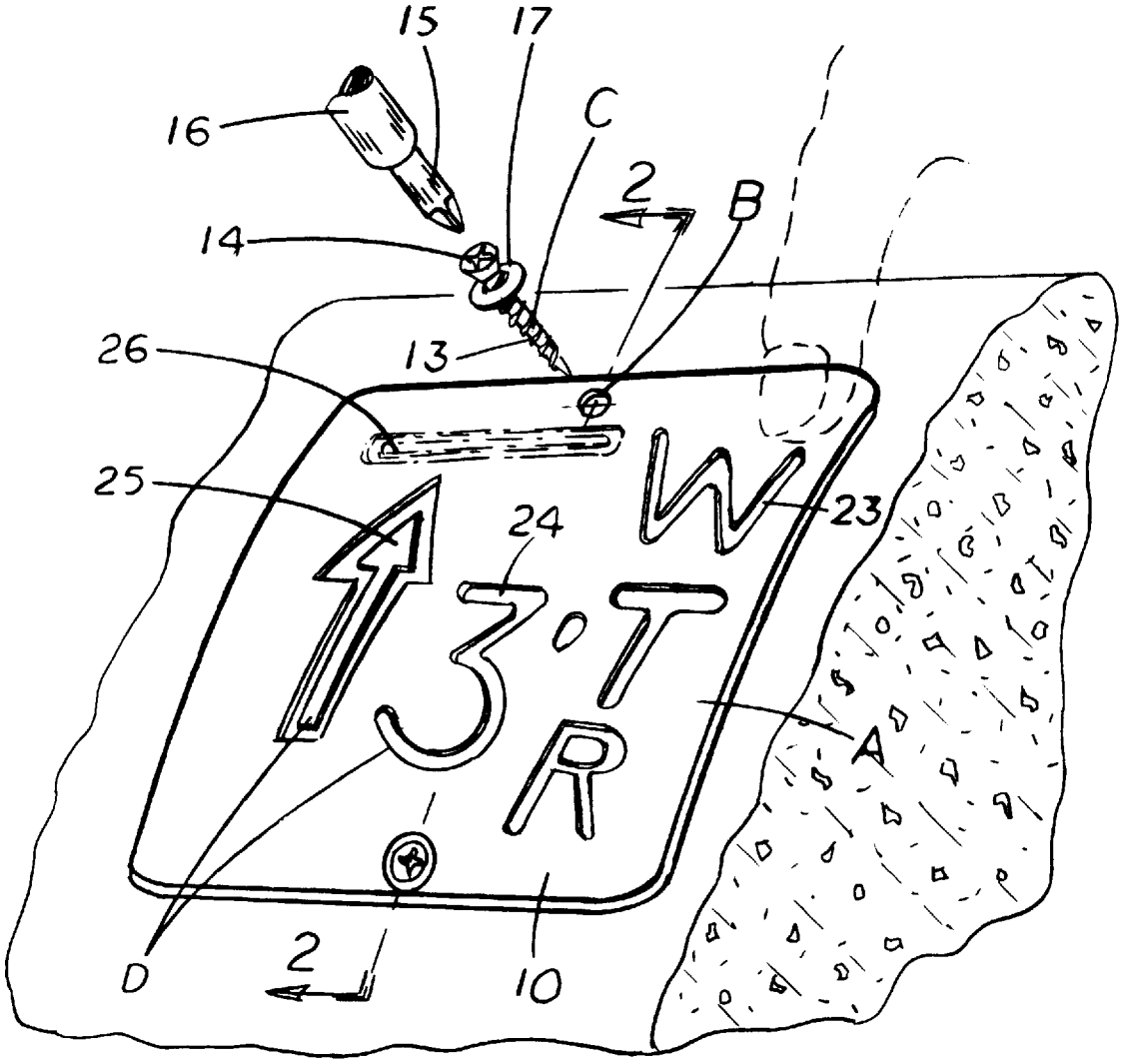
FIG. 1 is a perspective view illustrating the method of affixing the tiles to the road surface wherein holes are drilled in the curbing or roadway paving for receiving screws while the tiles are held in position as against a curved surface of a curb for permitting the setting up of adhesive on the back of the tile.
Figure 3:
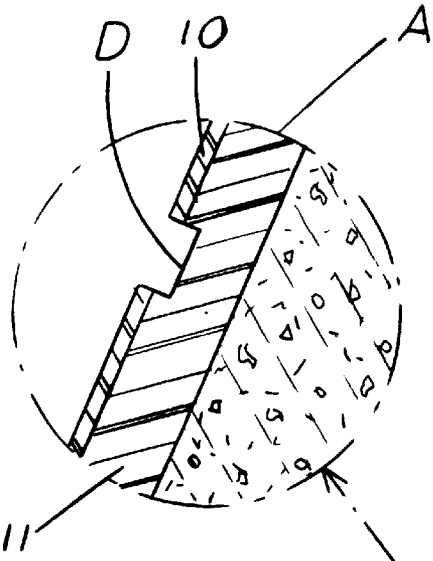
FIG. 3 is an enlarged portion of the tile shown in FIG. 1 illustrating the engraving of an exterior front layer to permit an indented surface on the tile utilizing an underlying portion of a back layer as a permanent indicia together with an illustration of the gluing of the backing of the tile to the roadway surface.
Figure 2:
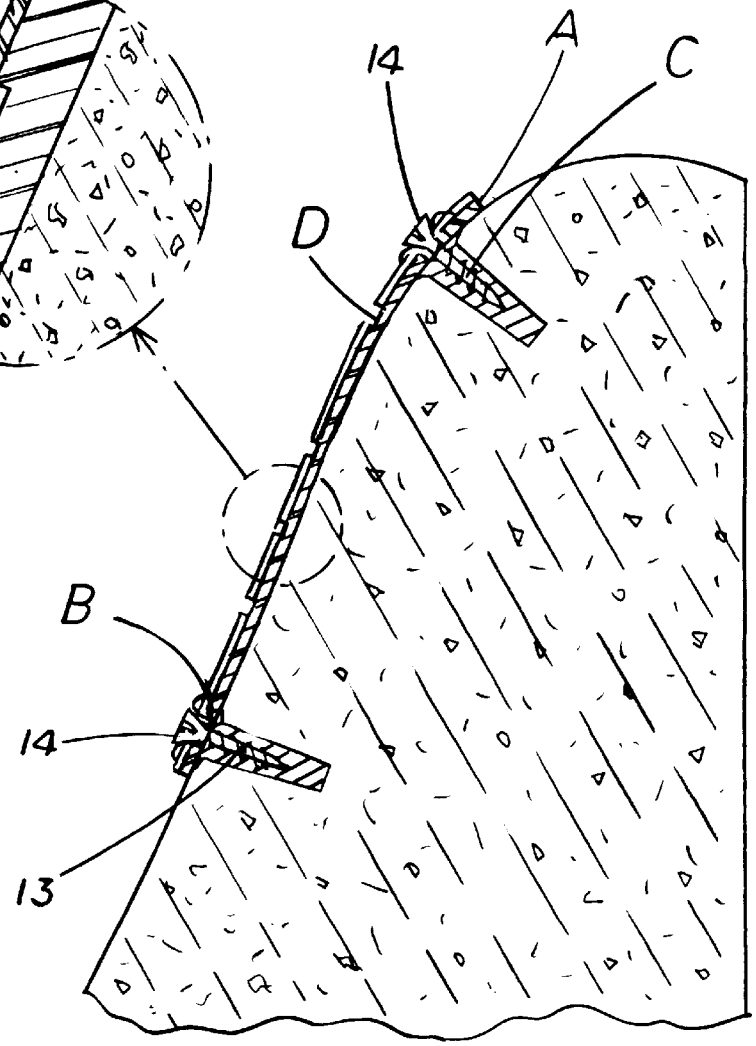
FIG. 2 is a transverse sectional elevation taken on the line of 2-2 in FIG. 1.
Figure 4:
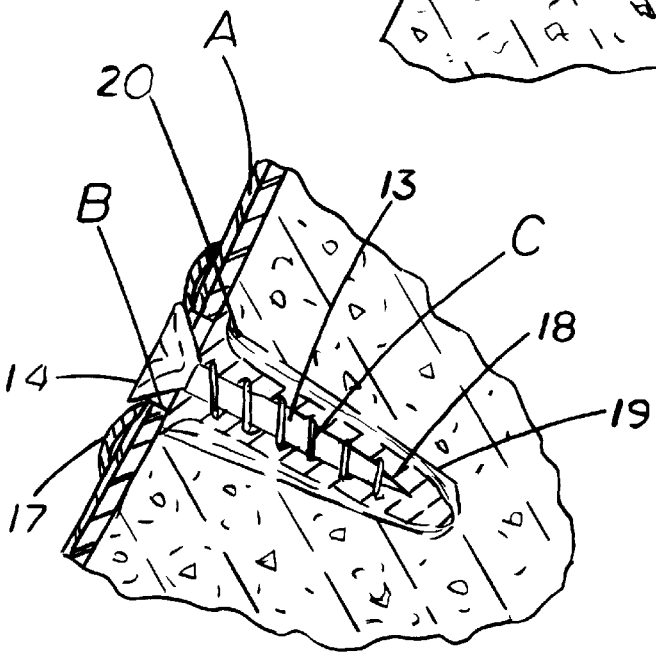
FIG. 4 is an enlarged sectional elevation of a mechanical fastener such as illustrated in FIG. 2 positioned in a curb.
Figure 5:
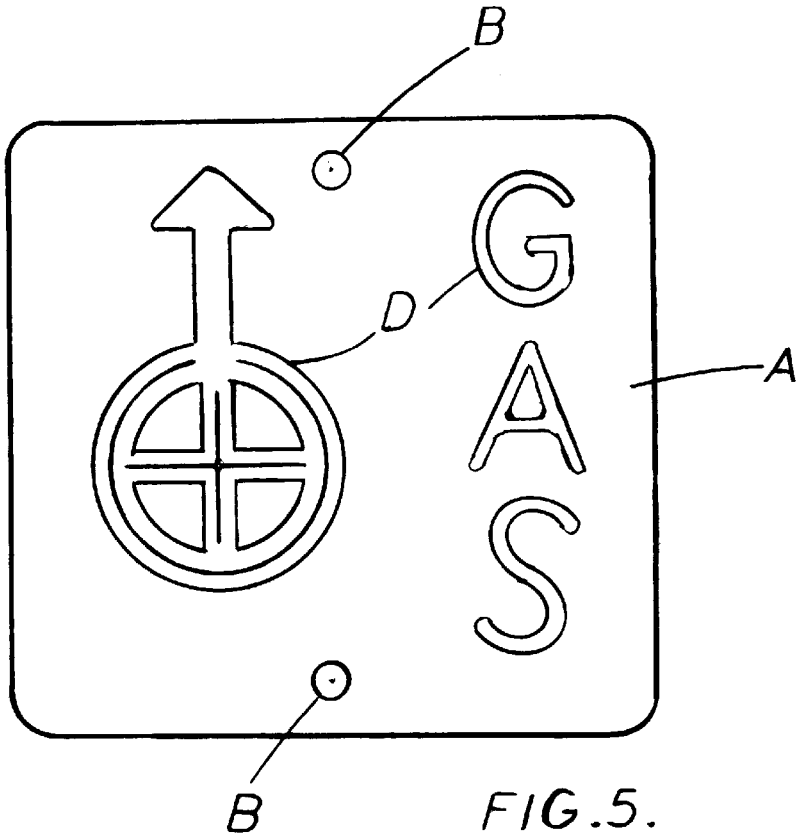
FIG. 5 is a further illustration of a front face of the tile showing a modified form of indicia wherein engineering symbols are employed in addition to letters as well as plastic material which may have coloring material incorporated herein for resistance to UV rays.

The drawings illustrate a marker and method for use on roads for locating underground utilities and the like. A flexible tile A is constructed of layers of plastic material fused together for affixation to a road surface. A color coding material is incorporated in a front layer of the plastic material. A backing layer on the tile is provided for receiving an adhesive and may also incorporate color coding material. Opposed marginal openings B are provided in the tile for receiving elongated fasteners C extending into opposed holes drilled in the road surface for maintaining the tile in position while the adhesive is setting. Suitable symbols D on the tile indicate the nature of the utility located thereby. A package may be provided utilizing a box E or other container for carrying a number of tiles A together with a supply of adhesive product F and screw fasteners C.

The flexible tile A is shown as incorporating a front layer 10 together with a backing layer 11 either or both of which may have coloring material incorporated herein which is resistant to UV rays. The layers of plastic material are fused together preparatory to affixing the tiles to the road surface. A suitable material bonded together by fusing is supplied under the trademark 2-Plex by AtoHaas North America, Inc. of Philadelphia, Pa. Such material for use in forming the tiles is a blended acrylic extruded sheet with cap or front and core backing material permanently fused together forming a UV stable engraved material for outside use to withstand the elements and high traffic. The holes B may be provided in the tiles in single pairs or in multiple opposed pairs by drilling or stamping the material and indicia may be placed therein by engraving using a suitable tool such as a carbide drill. The fastener assembly includes elongated fastening members having a threaded shank such as is illustrated as at 13. A screw head 14 may be recessed to accommodate the bit 15 of a hand-powered screw driver 16. The fastener C further includes counter sink washers 17 adapted to bear against the front surface of the front layer of the tile whereas an anchor 18 is utilized to affix a suitable adhesive together with the threads in the corresponding holes 19 drilled in the curbing material as illustrated.

Color coding material may appear in the cap or front layer of the tile or in the core or backing layer. In either case it is important that the color coding material be visible from the front either in the front layer or in an exposed indicia forming portion of the backing layer.

INSTALLATION

Figure 6:
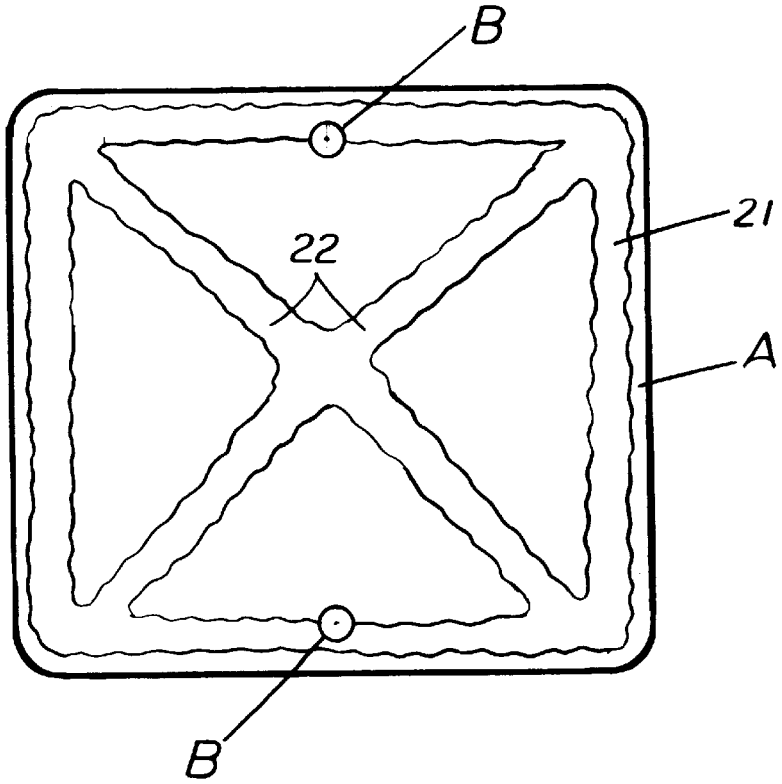
FIG. 6 is a rear plan view illustrating the application of adhesive to a backing layer of the tiles preparatory to placement and affixation upon any desired road surface preferably at the curb or the edge of the pavement.

The tile is placed on a curb or at the edge of a roadway pavement. The placement of the holes in the roadway is accomplished by first marking the surface with a punch, pencil or the like. A carbide tipped drill bit may be utilized to drill the holes. The excess dust and debris is brushed away. Suitable adhesive is applied to the plastic anchors 18 and the anchors are placed in the holes until the upper flange 20 of the anchors is adjacent the top of the curb or asphalt surface. Adhesive is applied to the backing surface of the tile in a configuration wherein a layer is placed about the marginal portions as illustrated in FIG. 6 at 21 with a crossing pattern illustrated as at 22.

Figure 7:
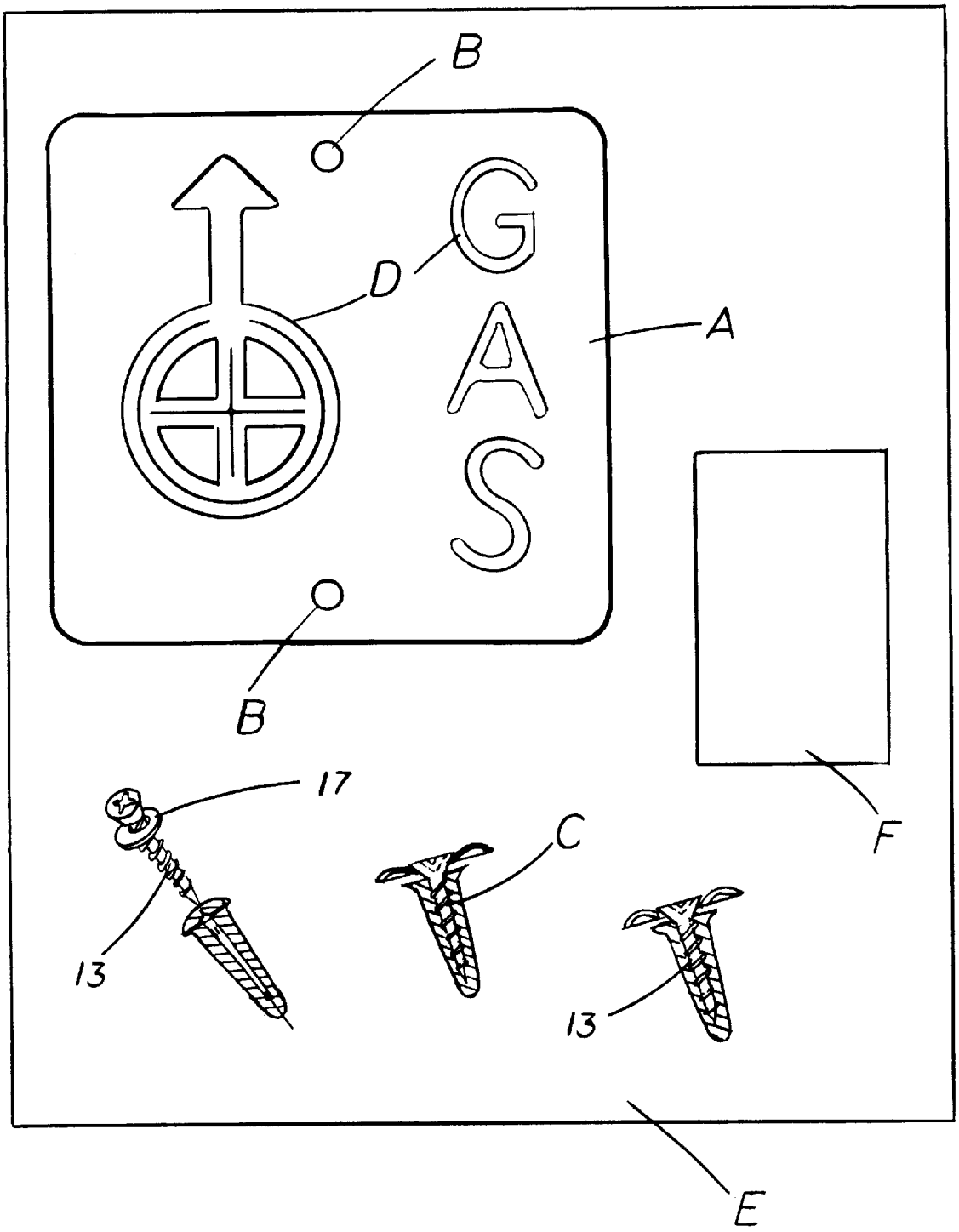
FIG. 7 is a schematic top view illustrating a box and contents including the various components which are maintained in juxtaposition for installation of the tiles.

A suitable adhesive product F is supplied by Eclectic Products, Inc. Of Eugene, Oreg. under the name E-6000 CLEAR. The indicia utilized herewith may include letters indicated at 23, numbers at 24 as to indicate distance together with engineering markers including arrows 25 and reference lines 26. Some of the utilities which may thus be indicated include valves, junction boxes, communication pedestals, cable TV pedestals, sewer service inducting main crossing indicators and conduit crossing indicators, flex conduits, service regulators, blow-offs, electrical road crossings, ends of water and gas mains, various service locations, offset markers and including distances, underground test locations, meter pits, and main offset and crossing markers. The components are carried in a box E as illustrated in FIG. 7 forming a package or kit.

While a preferred embodiment of the invention has been described using specific terms, such description is for illustrative purposes only, and it is to be understood that changes and variations may be made without departing from the spirit or scope of the following claims.

What is claimed is:

1. A marker assembly comprising:

a flexible tile including layers of plastic material joined together for affixation to a road surface;

a color coding material incorporated in a front layer of said layers of plastic material;

said layers of plastic material further including a backing layer on said front layer of plastic material of contrasting color therewith;

a fused interface bonding said front layer and said backing layer in superimposed relation forming a unitary structure of plastic material capable of flexing to conform to a road surface;

indicia in said flexible tile formed by removal of a portion of said front layer corresponding to a configuration of said indicia for supplying information concerning a utility located thereby;

elongated mechanical fasteners;

spaced opposed marginal openings in said tile for receiving the elongated mechanical fasteners in the road surface against which said tile is to be fastened for flexing the tile to conform to the road surface;

an adhesive product for application to a back surface of said tile to fasten the tile to the road surface;

a container for carrying the tile, the elongated mechanical fasteners, and the adhesive product; and said flexible tile, said mechanical fasteners and said adhesive product being retained by said container in juxtaposition for applying adhesive to the back surface of said flexible tile prior to flexing the tile to conform to the road surface and thereafter securing the tile in such flexed position by insertion of the elongated fasteners into the road surface for retention and setting up of the adhesive.

2. The marker assembly set forth in claim 1 wherein said indicia are formed by grinding away portions of said front layer leaving underlying portions of said backing layer exposed.

* * * * *